US005255757A

United States Patent [19]

Horowitz et al.

[11] Patent Number: 5,255,757

[45] Date of Patent: Oct. 26, 1993

[54] COLLAPSIBLE LADDER

[75] Inventors: Martin Horowitz, Box 2622, Aspen, Colo. 80612; Mark Joseph, Aspen, Colo.

[73] Assignee: Martin Horowitz, Aspen, Colo.

[21] Appl. No.: 944,161

[22] Filed: Sep. 9, 1992

[51] Int. Cl.[5] ..... E06C 5/00

[52] U.S. Cl. ..... 182/127; 182/199; 182/206; 182/92; 182/93

[58] Field of Search ..... 182/127, 150, 196–199, 182/206, 93, 187, 92

[56] References Cited

U.S. PATENT DOCUMENTS

| | | | |
|---|---|---|---|
| 2,829,702 | 4/1958 | Keating | 182/3 X |
| 3,817,351 | 6/1974 | Mikkelson | 182/196 X |
| 4,189,030 | 2/1980 | Leslie et al. | 182/196 |
| 4,475,628 | 10/1984 | Heilskov | 182/198 |
| 4,770,373 | 9/1989 | Salo | 182/93 X |

FOREIGN PATENT DOCUMENTS

| | | | |
|---|---|---|---|
| 993164 | 10/1951 | France | 192/196 |
| 687780 | 2/1953 | United Kingdom | 182/197 |

*Primary Examiner*—Alvin C. Chin-Shue

*Attorney, Agent, or Firm*—Glenn L. Webb

[57] ABSTRACT

The present invention provides a portable collapsible ladder that is easily secured onto a vehicle or structure mounted on a vehicle, such as a roof-top rack, to provide ease of access to the upper portion of the vehicle. The ladder of the present invention includes a flexible body portion that is easily folded.

Upper strap assemblies extend from opposing sides of the upper portion of the flexible body portion. Angularly shaped hook members are secured to each of the strap assemblies. A lower strap assembly extends from the lower portion of the flexible body portion. An elastic strap joins the lower strap assembly to a lower hook member.

In use, the flexible body portion is unfolded so the upper strap assemblies are extended. The upper hook members are secured on the vehicle or structure on the vehicle. The lower hook member is then secured over the seam of the lower vehicle body. Protective bumpers on the outer side of the flexible body portion protect the vehicle from damage from the ladder. After use, the ladder is folded into itself to form a compact carrying case.

22 Claims, 6 Drawing Sheets

FIG. 1
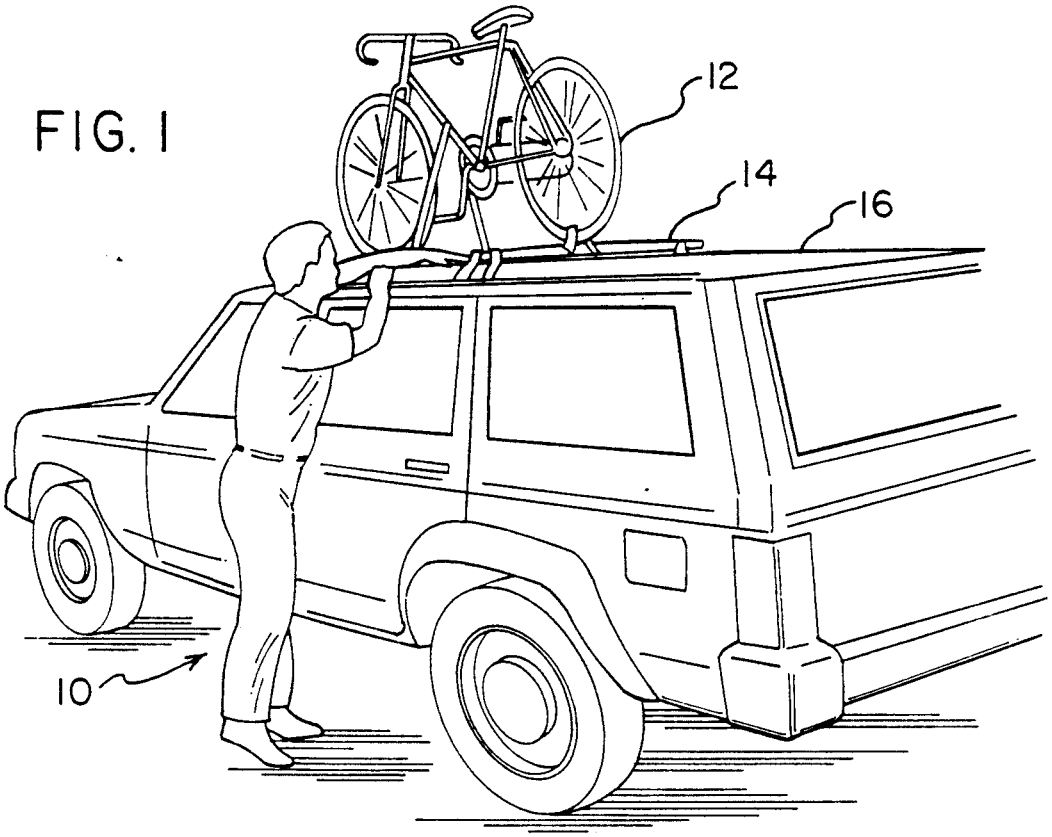
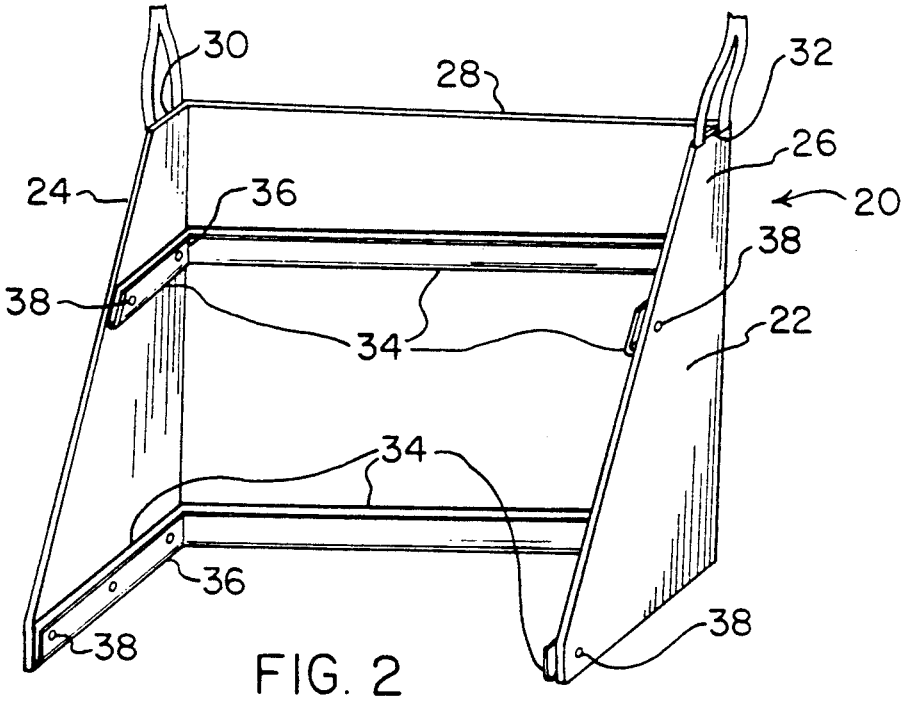
FIG. 2

FIG. 9A
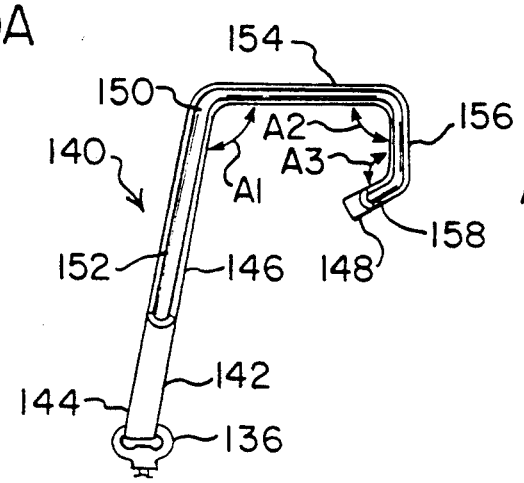
FIG. 9B
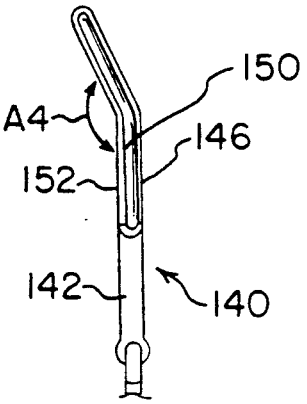
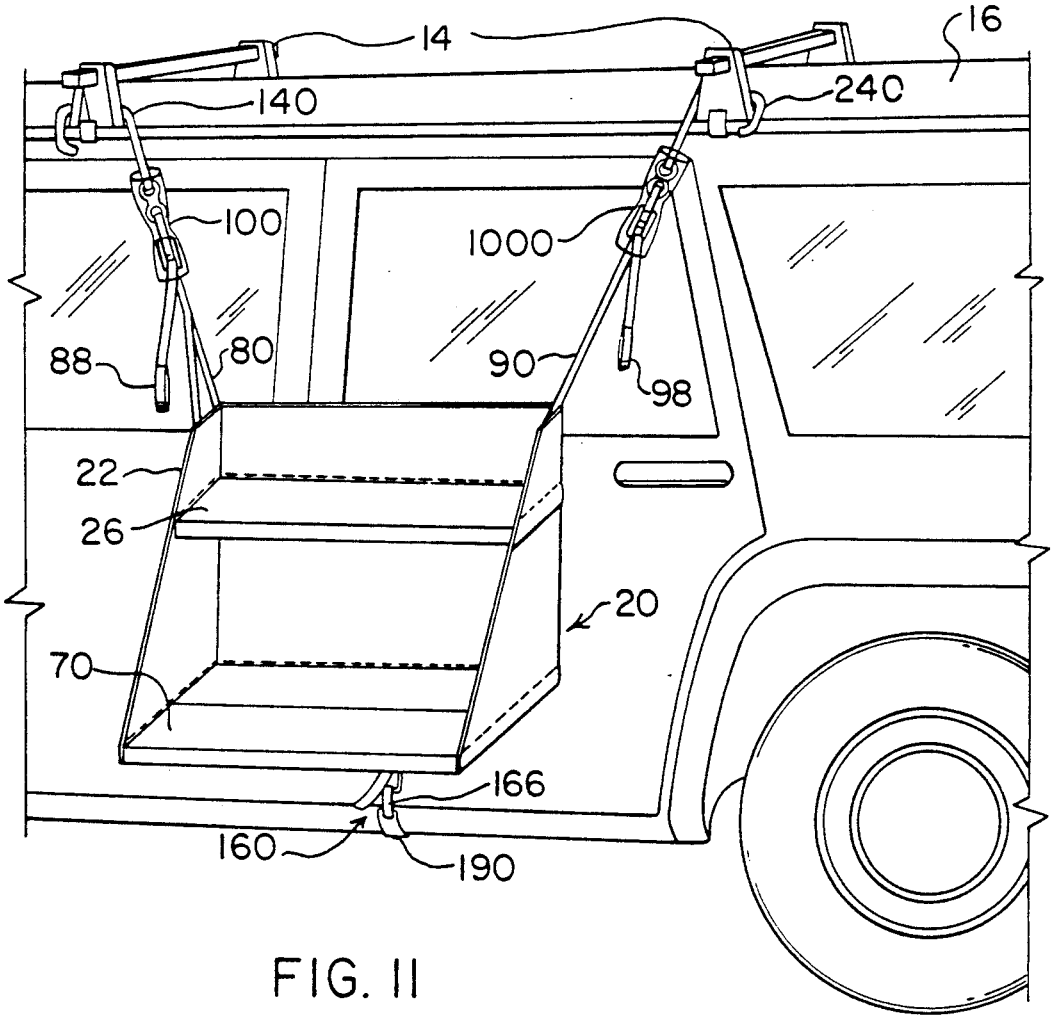
FIG. 11

COLLAPSIBLE LADDER

BACKGROUND OF THE INVENTION

1. Field of the Invention

The present invention relates to the field of portable ladders, and particularly to the field of collapsible portable ladders for accessing roof-top racks of vehicles and boarding ladders for marine vehicles.

2. Statement of the Problem

Roof-top racks are frequently mounted on vehicles to increase the storage capacity of vehicles. Such racks are used for transporting a wide variety of items. These roof-top racks can include bicycle racks, ski racks, and racks for other types of sports equipment, i.e., canoes, wind-surfers, hang gliders, and the like. Luggage carriers are also often mounted on roof-top racks to increase storage capacity. A problem with these racks is difficulty in gaining access to the items carried on these racks. This problem is particularly acute when attempting to load and/or unload items on these racks.

Four-wheel drive vehicles having a high ground clearance and vans having a high roof require an extensive reach in order to use roof-top racks on these types of vehicles. Also, shorter individuals often have difficulty in using roof-top racks due to lack of reach. Attempts to access the items on the roof-top racks on the vehicle usually include stepping in the interior of the vehicle or on a vehicle wheel which places the individual in a off-center position for loading or unloading the items. In either situation, an individual must work around an open door or the vehicle wheel. The vehicle is not designed for this type of use and the individual is placed in a precarious position.

Often people carry a riser, such as a small step-ladder, in the vehicle in order to access items on the roof of the vehicle. These risers take up space within the vehicle and are often precarious to use. The ground near the vehicle may be uneven causing the riser to be unstable. Also, the center of gravity of the individual on the riser is over the side of the riser when the individual is placing an item on the vehicle roofor removing an item from the vehicle roof. This places the individual in an unbalanced and precarious position.

A similar problem occurs with commercial trucks and utility trucks. Often, these trucks are sufficiently tall that it is difficult to reach items on upper portions of these trucks. Some of these trucks are even difficult to climb into the operators seat.

Prior attempts to solve these problems include the use of a fixed-ladder, such as ladders mounted on recreational vehicles or on large equipment. Fixed-ladders detract from the appearance of the vehicle as well as disrupting the aerodynamics of the moving vehicle. Normally, the need for access to the roof-top racks is limited according to the type of activity for which the racks are used. Therefore, most of the time a ladder is neither needed or desired on the vehicle. Also, different types of racks and different types of vehicles require different sizes of ladders.

Additional access problems include problems arising with boarding boats and other marine vehicles. This is particularly true for boating activities requiring entry into the boat from the water, such as water-skiing or scuba diving. The individual either must pull their body over the side of the boat to reenter the boat or use a ladder placed over the side of the boat. Boat ladders normally do not extend below the water line of the boat.

Thus, an individual must possess sufficient upper body strength to pull themself up onto the ladder in order to gain footing on the ladder, be flexible enough to engage the ladder above the water surface or have assistance in getting into the boat.

Thus, a problem exists in that presently there is no suitable technique for easily accessing items secured on an upper area of a vehicle or for easily boarding a boat from the water.

3. Solution to the problem

The present invention solves this problem and others by providing a portable collapsible ladder. The collapsible ladder of the present invention is stowable beneath a seat or in the trunk of a vehicle. The ladder can be unfolded and easily secured to a roof-top rack, an upper portion of a vehicle or adapted to engage the side rail of a boat when needed. The ladder is securely mounted onto the rack and the vehicle so the individual using the ladder is able to safely manipulate items for loading and unloading.

This ladder is designed not to damage the surfaces of the vehicle on which it is mounted. This ladder is also easily adjustable to fit onto a wide variety of vehicles, including boats, and onto a wide range of rack systems. This ladder can be formed with a plurality of steps as needed.

Other features of the collapsible ladder of the present invention is the compact storage of this ladder. The collapsible ladder can be compactly folded to be stowed in the vehicle or easily transported about. The collapsible ladder of the present invention enables an individual to quickly secure the ladder on the vehicle or rack for ease of access to a roof-top rack for loading and unloading of items.

SUMMARY OF THE INVENTION

The present invention provides a portable collapsible ladder that is easily secured onto a vehicle or on a structure mounted on a vehicle, such as a roof-top rack, to provide ease of access to the upper portion of the vehicle. The ladder of the present invention includes a flexible body portion that is easily folded. The flexible body portion includes a series of pockets formed from doubled webbing or other fabrics.

A plurality of rectangular steps are formed from a lightweight, high strength material, such as aluminum alloy, wood or plastic. Each of the steps include raised holes to improve the footing grip on the steps. The steps have downwardly extending front, rear and side surfaces. Slots are formed in the edges of each of the downwardly-extending side surfaces.

The downwardly-extending side and rear surfaces are inserted in the pockets of the flexible body portion. Seams at the rear of the pockets and rivets near the front of the pockets engage the slots on the side surfaces. The steps are thus securely affixed to the flexible body portion. The lower step segment on the ladder includes two steps secured to one another to provide a greater footing area.

In an alternative embodiment, channels are formed in the sides of the steps. A cording wrapped with heavy nylon is inserted into the channels. The nylon is stitched onto the inside of the flexible body portion to support the steps on the flexible body portion.

Protective bumpers are attached on the outer surface of the flexible body portion in the region adjacent the step segments. These protective bumpers protect the vehicle on which the ladder is mounted from damage from the ladder.

Upper strap assemblies extend from opposing sides of the upper portion of the flexible body portion and step segments. The upper strap assemblies each include a strap threaded through a quick release cam lock buckle. These buckles allow the straps to be easily pulled through but resist the movement of the straps back through the buckle until the cam is released. This allows quick adjustment of the effective length of the strap assemblies.

In the preferred embodiment, each of the buckles are mounted to a swivel joint to ensure that the straps are flat against the vehicle. Angularly shaped hook members are secured to each of the swivel joints. Each of the hook members are shaped to engage most roof-top attachments over the upper edges of the vehicle. These hook members are also designed to fit over the contours of the vehicle and over rain gutters if the vehicle includes rain gutters.

A lower strap assembly extends from the lower portion of the flexible body portion and the lower step segment. The lower strap assembly also includes a strap threaded through a quick-release cam lock buckle. An elastic strap joins the buckle to a lower hook member. The elastic strap takes up any slack in the ladder due to weight applied on the steps to keep the ladder engaged on the vehicle.

In use, the flexible body portion is unfolded so the upper strap assemblies are extended. The upper hook members are secured onto the vehicle or onto the roof-top attachment. The upper hook members may engage spaced portions on the attachment or vehicle or, in some situations, the same portion. The upper strap assemblies are adjusted until the steps are at an appropriate height and substantially level. The lower hook member is then secured over the seam of the lower vehicle body. The lower strap assembly is then adjusted to tightly secure the ladder on the vehicle.

After the ladder is no longer required, the tension on the lower strap assembly is released. The lower and upper hook members are then removed and the ladder folds to form a compact carrying case. The ladder can then be easily stowed away until it is needed.

The ladder of the present invention is usable on a wide range of vehicles including boats. The ladder can also be easily adapted for a variety of uses. The features of the present invention are evident from the drawings and the detailed description of a preferred embodiment.

BRIEF DESCRIPTION OF THE DRAWINGS

FIG. 1 is a prior art view of a bicycle mounted on a roof-top carrier.

FIG. 2 is a perspective view of the flexible body portion of the ladder of the present invention.

FIG. 4(*b*) is a side cutaway view of the protective bumper.

FIG. 9(*a*) is a detail view of the upper hook member of FIG. 4.

FIG. 9(*b*) is a side view of the upper hook member of FIG. 9(*a*).

FIG. 11 is a perspective view of the ladder of FIG. 4 mounted on a vehicle.

DETAILED DESCRIPTION OF THE PREFERRED EMBODIMENT

The present invention provides a portable collapsible ladder that is easily secured onto a vehicle or onto a structure mounted on a vehicle, such as a roof-top rack, to provide ease of access to the upper portion of the vehicle. Access to the upper areas of the vehicle and roof-top structures is often difficult, particularly on taller vehicles such as four-wheel drive vehicles or vans. For example, as shown in FIG. 1, it is difficult for an individual 10 to unload bicycle 12 from roof-top rack 14 mounted for transporting on vehicle 16. Typically, this process in the past has required either a tall individual or else the use of a riser, such as a step ladder. Even when the individual uses the vehicle itself as a riser by stepping on the wheel or in the interior of the vehicle, the loading and unloading process is difficult as well as unsafe. The individual is forced to work around the vehicle doors and wheels. Also, the individual is normally off-center during the loading and unloading process in a precarious position.

The present invention provides a safe and easy method to provide access in such situations. A preferred embodiment of the present invention is illustrated in FIGS. 2–12. It is to be expressly understood that the present invention is not meant to be limited by this descriptive embodiment which is provided for explanatory purposes. Other embodiments and variations are considered to be within the scope of the present inventive concept.

Figure 4A:
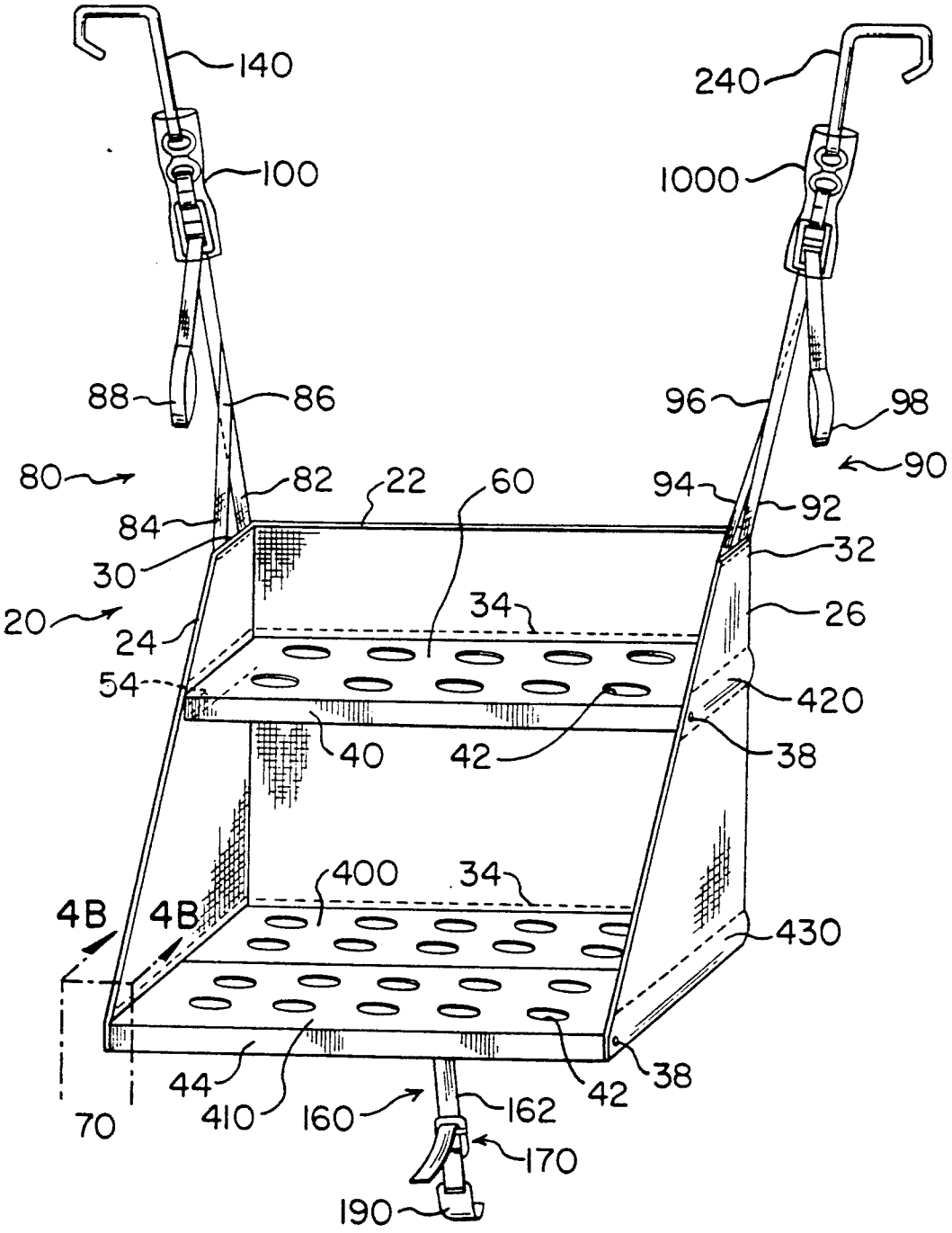
FIG. 4(*a*) is a perspective view of a preferred embodiment of the ladder of the present invention fully unfolded.
Figure 4B:
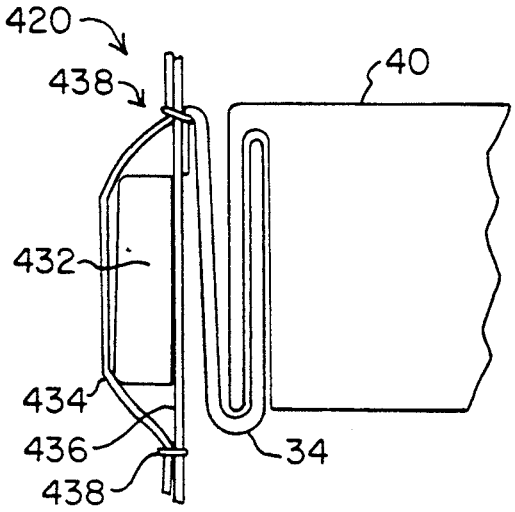

Collapsible ladder 20, as shown in FIG. 4, includes a collapsible body portion 22, shown in detail in FIG. 2. Collapsible body portion 22 is formed from a high strength durable material such as heavy weight nylon fabric. Collapsible body portion 22, in the preferred embodiment, is formed of two layers of this material to provide added strength. This material is sufficiently flexible so that it can be easily collapsed or folded for compact storage.

In this embodiment, collapsible body portion 22 includes substantially triangularly- shaped side portions 24, 26 and a rectangular back portion 28. The upper side portions 30, 32 of sides 24, 26 are "squared" to enable straps, discussed below, to be secured thereto. Pockets 34 are formed at the mid-portion and the lower portion of body portion 22, as shown in FIGS. 2. Fabric or webbing, such as canvas or nylon, is folded to form pockets 34 and stitched or affixed by other well known techniques to body portion 22. Seam 36 formed by stitching through pocket 34 extends through pockets 34 at selected areas on body portion 22. Also, rivets 38 extend through pockets 34 at selected areas on body portion 22.

Figure 3:
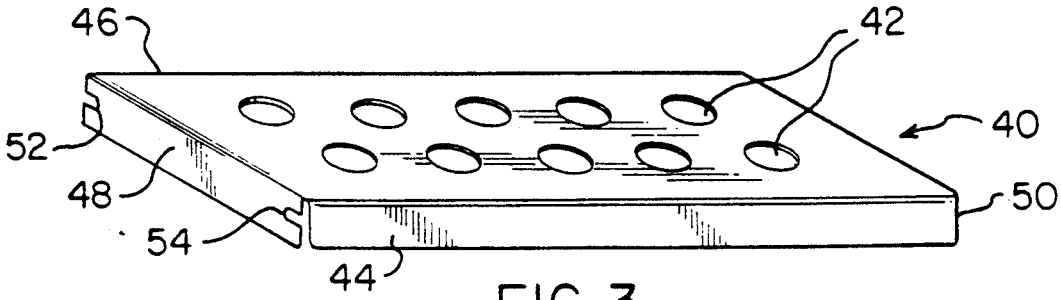
FIG. 3 is a perspective view of a step of the ladder of the present invention.
Figure 5:
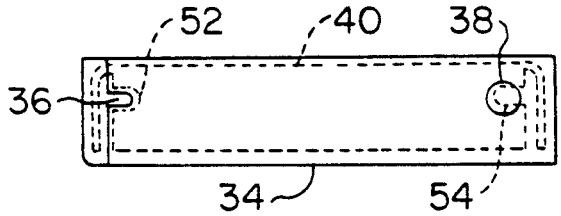
FIG. 5 is a side cutaway view of the upper step portion of FIG. 4 along lines 5—5.
Figure 6:
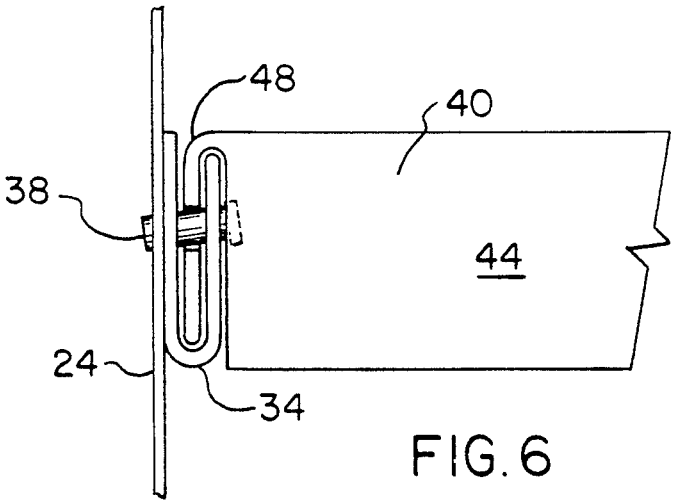
FIG. 6 is a front cutaway view of the upper step portion of FIG. 4 along lines 6—6.

Steps 40 are affixed to the interior of collapsible body portion 22 as discussed below. In the present invention, step 40 shown in FIG. 3, is formed of lightweight aluminum alloy, such as aluminum 5052H32 having a thickness of about eighty hundredths (0.80) of an inch. Other materials, such as plastic, wood and the like,, can be used as well. Preferably these materials are relatively lightweight, high strength materials that are durable.

In the preferred embodiment, as shown in FIG. 3, step 40 has a width of about five and one-half (5.50) inches and a length of about fourteen (14) inches. Holes 42 have a diameter of about one (1.0) inch and spaced about one and one-half (1.50) inches apart in rows about one (1.0) inch apart. A raised portion on each of holes 42 extend about one-tenth (0.100) of an inch above the surface of the steps. These raised holes 42 improve the footing on the steps. The present invention is not meant to be limited to the described size and shape of these steps. Other configurations of steps are contemplated as within the scope of the inventive concept.

Step 40 includes downwardly extending front edge 44 and downwardly extending rear edge 46. Side edges 48, 50 also extend downwardly from each side of step 40. Front edge 44, rear edge 46, and side edges 48, 50 are noncontinuous thus forming notches between each of the edges. Slots 52, 54 are formed in each end of side edge 48, shown in FIG. 3. Slots 56, 58 (not shown) are formed in a similar manner in side edge 50.

Collapsible ladder 20, as shown in FIG. 4, includes upper step segment 60 and lower step segment 70. It is to be expressly understood that the number of steps provided by the present invention can vary according to the particulars of the intended use of the present invention. Upper step segment 60 includes step 40 having rear edge 46 and side edges 48, 50 inserted into pockets 34 on the upper portion of body portion 22. Seam 36, at the rear of pockets 34 on the sides of body portion 22, engage in slots 52, 58 on step 40 as partially illustrated in FIGS. 5 and 6. Slots 54, 58 on step 40 engage rivets 38 in the front edges of pockets 34 formed on the side portions of body portion 22 to reinforce step 40 to body portion 22. Thus, upper step segment 60 is securely affixed on body portion 22.

Figure 7:
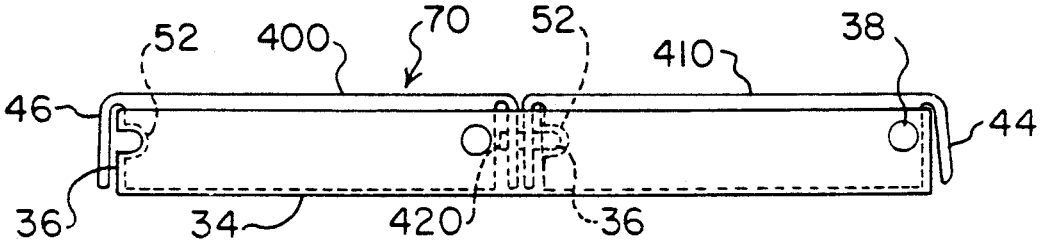
FIG. 7 is a side cutaway view of the lower step portion of FIG. 4 along lines 7—7.

Lower step segment 70, shown in FIG. 4, includes steps 400, 410, each of which are substantially identical to step 40 described above. Steps 400, 410, shown in FIG. 7, are secured in pockets 34 on the lower portion of body portion 22. Seams 36 engage in slots 52, 56 on the rear of step 400 and slots 52, 56 on the rear of step 410. Slots 54, 58 on step 410 engage rivets 38 on the front edges of pockets 34 to reinforce step 410 on body portion 22. If additional reinforcement is desired, slots 54, 58 on step 400 can be engaged by additional rivets 38. Steps 400, 410 are secured together by rivet 420 or other fasteners at the mid-portion of their abutting edge surfaces. Lower step segment 70 thus has a larger area to assist the user in gaining the first step on ladder 20.

Pockets 34, formed of fabric or doubled webbing, also provide a measure of protection from the steps scratching or damaging the finish of the vehicle on which the ladder is mounted. However, in another embodiment, a bumper, such as bumper 420, 440 shown in FIG. 4(*b*) can be secured about the outer area of body portion 22 adjacent the steps. The bumper can be formed of polyurethane or other soft resilient material. For instance, polyurethane foam 432 inside two nylon layers 434, 436 is affixed onto flexible body portion 22 by stitches 438 to form bumpers 430, 440 as shown in FIGS. 4(*b*).

Ladder 20, shown fully assembled in FIG. 4, includes flexible body portion 22, upper step segment 60, lower step segment 70, upper strap assemblies 80, 90 and lower strap assembly 160. The strap assemblies will be more fully described below.

Upper strap assembly 80 includes straps 82, 84 securely affixed onto upper end 30 of side 24 of collapsible body portion 22 by stitching or other conventional techniques. Likewise, upper strap assembly 90 includes straps 92, 94 also secured affixed onto upper end 32 of side 26 of collapsible body portion 22. Straps 82, 84, 92, 94 are formed from a flexible, high strength material, such as one-inch wide nylon webbing. A stiffener, made of aluminum or plastic, (not shown) can be inserted in the areas where the straps are affixed to provide additional strength. Strap 84 is affixed onto strap 82 at a mid-region 86 of strap 82 and extends folded over the edge of fabric portion 22 down to the front of lower step segment 410. Strap 94 is affixed onto strap 92 at a mid-region 96 of strap 92 and extends folded over the edge of fabric portion 22 down to the front of lower step segment 410. This provides extra support for the front edges of steps 40, 410. This provides stability to the ladder when in use as well as reducing the stress at the upper portion areas 30, 32. The free end of strap 82 is doubled to form loop 88. The free end of strap 92 is doubled in a similar manner to form loop 98.

Figure 8:
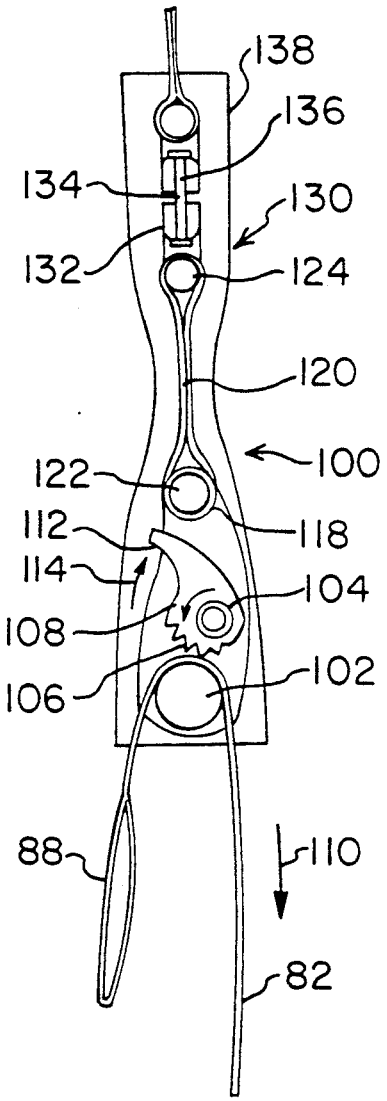
FIG. 8 is side detail view of the upper strap assembly of FIG. 4.

Strap 82 is inserted through buckle assembly 100 as illustrated in FIGS. 4 and 8. Strap 92 is also inserted through buckle assembly 1000, as shown in Figure 4. Since the operation of both buckle assemblies 100, 1000 are similar, only buckle assembly 100 and strap 82 will be discussed in detail.

Buckle assembly 100, as shown in FIG. 8, includes cam pin 102 over which strap 82 is threaded. Cam pin 102 has a low friction surface to reduce abrasion against strap 82. Cam lock 104 includes teeth 106 biased by a spring (not shown) in the direction of arrow 108 against strap 82. The engagement of teeth 106 against strap 82 is increased as weight is applied on strap 82 in the direction of arrow 110, such as when weight is applied on step segments 60, 70. Thus, strap 82 is securely locked at a desired effective length. Other buckle assemblies other than well known buckle assembly 100 can be used as part of the overall inventive concept.

Lever portion 112 of cam 102 is rotated upwards in the direction of arrow 114 to release the engagement of teeth 106 against strap 82 to allow the effective length of strap 82 to be adjusted. Alternatively, strap 82 can be grasped by strap loop 86 and pulled downward in the direction of arrow 108 which will shorten the effective length of strap 82. Movement of strap 82 in the direction of arrow 108 will rotate teeth 106 against the bias of the spring and allow one-way movement of strap 82. This operation allows straps 82 and 92 to be quickly adjusted when mounted on a vehicle.

In the preferred embodiment, buckle assembly 100 includes strap 120 having first loop portion 122 engaging pin 118 and second loop portion 124 engaging swivel joint 130. Lower member 132 of swivel joint 130 is rotatably mounted on pin 134. Upper swivel joint member 136 is also rotatably mounted on pin 134. Clear plastic protective sleeve 138 covers buckle assembly 100 to protect the surface of the vehicles from damage from the collapsible ladder. These swivel joints can be eliminated in other embodiments of the inventive concept.

Hook members 140, 1400, shown in FIG. 4, are affixed onto the upper portions of swivel joints 130, 1300, respectively. Since hook members 140, 1400 are similar, only hook member 140 will be discussed in detail. Hook member 140, shown in FIGS. 9(*a*), 9(*b*), includes outer webbing 142, formed of nylon or the like. Lower portion 144 of outer webbing 142 is affixed to upper portion 136 of swivel joint 130. Plastic tubing 146 or vinyl coating is located on the interior of outer webbing 142 covering steel rod 150. The plastic or vinyl coating protects against the steel rod 150 rupturing or abrading through outer webbing 142 and scratching the finish of the vehicle. Outer webbing 142 is stitched closed at outer end 148.

Hook member 140 is shaped to quickly and easily fit over the contours of most vehicles and roof racks as well as to have a stabilizing effect when weighted. Portion 152 extends upwardly from swivel joint 130. Portion 154 extends angularly from portion 152 at about 110 degrees as indicated by A,. Portion 156 extends angularly downward from portion 154 at about 90 degrees as indicated by A,. Portion 158 extends inward from portion 156 at an angle of about 140 degrees, as indicated by A,. Portion 152 further includes a side bend, as indicated by A4 to allow hook member 140 to fit over the contours of the vehicle roof as well as rain gutters on certain vehicles.

Figure 10:
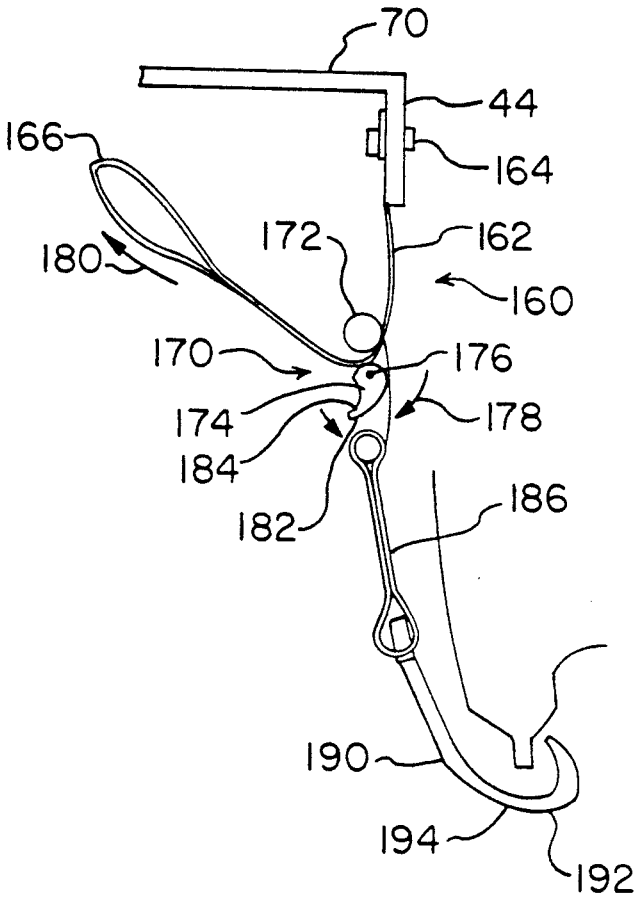
FIG. 10 is a detail view of the lower hook member of FIG. 4.

Lower strap assembly 160, shown in FIGS. 4 and 10, includes strap 162 secured to rear edge 46 of lower step segment 70 by fastener 164. Strap 162, formed of about one (1.0) inch webbing, has its free end doubled back to form loop 166. Strap 162 is threaded through buckle assembly 170 similar to buckle assembly 100 described above.

Buckle assembly 170, as shown in FIG. 10, includes cam pin 172 over which strap 162 is threaded. Cam pin 172 has a low friction surface to reduce abrasion against strap 162. Cam lock 174 includes teeth 176 biased by a spring (not shown) in the direction of arrow 178 against strap 162. The engagement of teeth 176 against strap 162 is increased as force is applied on strap 162 in the direction of arrow 180. Thus, strap 162 is securely locked at a desired effective length.

Lever portion 182 of cam 172 is rotated downwards in the direction of arrow 184 to release the engagement of teeth 176 against strap 162 to allow the effective length of strap 162 to be adjusted. Alternatively, strap 162 can be grasped by strap loop 166 and pulled downward in the direction of arrow 178 which will shorten the effective length of strap 162. Movement of strap 162 in the direction of arrow 178 will rotate teeth 176 against the bias of the spring and allow one-way movement of strap 162. This operation allows straps 162 to be quickly adjusted when mounted on a vehicle and ladder 20 to be tautly secured against the vehicle.

Elastic strap 186 is secured on the lower portion of buckle assembly 170. The opposing end of elastic strap 186 is secured onto lower hook 190. Lower hook 190 includes curved metal sheet 192 having plastic coating 194. Elastic strap 186 keeps hook 190 engaged on the vehicle when the ladder is weighted downward.

OPERATION

Collapsible ladder 20 is easily mounted onto an upper portion of a vehicle or on a vehicle having a roof-top attachment when necessary. Collapsible ladder 20, normally stowed as a folded case as discussed below, is unfolded as shown in FIG. 4. Upper strap assemblies 80, 90 are fully extended. If necessary, the cam locks on buckle assemblies 100, 1000 can be released to lengthen strap assemblies 80, 90. Hook members 140, 1400 are swiveled to engage the upper portion of a vehicle or roof-top attachment, such as roof-top carrier 14 as illustrated in FIG. 11. Hook members 140, 1400, as shown in FIG. 11, engage spaced portions of roof-top carrier 14. In some situations, hook members 140, 1400 may be engaged the same portion of the roofor structure. Strap assemblies 80, 90 can be then grasped by loops 88, 98, respectively to adjust the lengths of strap assemblies 80, 90 until step segments 60, 70 are at the appropriate height and substantially level. If ladder 20 is used solely on one vehicle, then the adjustment is done once when the rack is mounted on the vehicle. The spring cam buckles will hold the adjusted position through repeated uses.

Lower strap assembly 160 can then be lengthened if necessary so that lower hook member 190 engages the lower vehicle body seam. Loop 166 is then pulled upward to secure ladder 20 against the vehicle body. This holds ladder 20 tautly to prevent movement of the ladder during use. Elastic strap 186 keeps lower hook member 190 engaged with the vehicle even when step segments 60, 70 are weighted downward. Additionally, the angular design of upper hook members 140, 1400 stabilize ladder 20 under the downward force of the weighted steps.

Thus, a stable ladder is securely mounted onto a vehicle to allow safe access to items mounted on the vehicle roof . The ladder of this invention is easily adjustable to a variety of vehicles and roof-top attachments.

STORAGE OF THE LADDER

An additional feature of ladder 20 is the ability to fold ladder into itself to form a compact carrying case that can be easily stowed in the vehicle. Ladder 20, after removing from engagement on the vehicle, is designed for compact storage. Upper hook members 140,, 1400 and upper strap assemblies 80, 90, are placed between upper step segment 60 and lower strap segment 70. The upper segment of body portion 22 is also collapsed over upper step segment 60. The segments of body portion 22 between upper step segment 60 and lower step segment 70 is folded inward between the step segments.

Lower strap assembly 160 is used as a closure strap to prevent the ladder from accidentally unfolding. Lower strap 162 is wrapped around upper step segment 60. Lower hook member 190 is then engaged with the rear edge 46 of lower step segment 70. Strap 162 is then pulled through the cam lock buckle assembly 170 to tightly package the entire ladder into a compact arrangement. Thus, ladder 20 forms its own carrying case.

Ladder 20, in this arrangement, can be easily transported about or stowed beneath a car seat or in the trunk of the vehicle until needed. When the ladder is again required, cam lock member 174 is rotated to release cam teeth 176 from strap 162. This releases lower hook member 190 from step 70 to allow ladder 20 to be unfolded. Ladder 20 is then mounted onto the vehicle as described above.

ADDITIONAL EMBODIMENTS

The ladder of the present invention is not meant to be limited to the above described exemplary embodiment. Other embodiments and uses are contemplated within the scope of the present inventive concept. For instance, in lieu of the upper hook members, straps may be buckled about the roof-top attachment. Also, the roof-top attachment may already have devices mounted thereon which are engaged by upper strap assemblies 80, 90. Upper strap assemblies 80, 90 may also include quick release buckles which secure ladder 20 onto the roof-top attachment.

Another embodiment uses a receptacle mounted onto a roof-top attachment. Ladder 20 is stored in this receptacle when not in use. Ladder 20 may also form a portion of the receptacle. Thus, ladder 20 need only be released from the receptacle and secured to the lower portion of the vehicle to be usable.

An additional embodiment of ladder 20 does not include lower strap assembly 160. The ladder is secured to the vehicle by the upper strap assemblies. The weight of the individual on the steps will hold the ladder substantially steady.

The ladder may also be stored in a box which doubles as a first step. This embodiment is particularly useful for smaller individuals in stepping up onto the lower step of the ladder. The ladder may also be formed with differing number of steps. For instance, three or more steps may be used or even only one step formed in the ladder.

Figure 14:
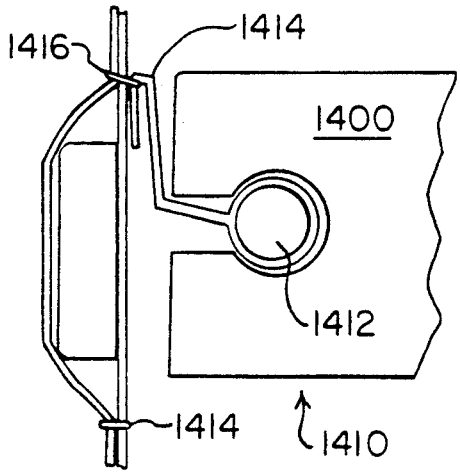
FIG. 14 is a side cutaway view of an alternative embodiment of attaching the steps on the ladder.
Figure 13:
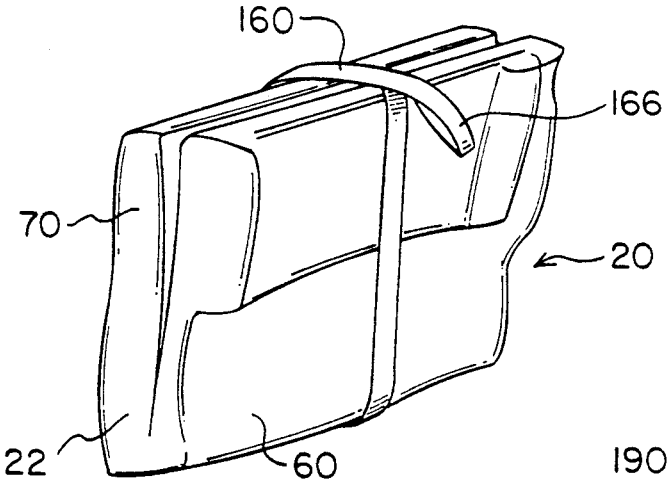
FIG. 13 is a perspective view of the ladder of FIG. 12.
Figure 12:
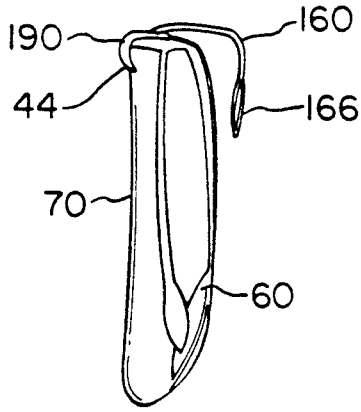
FIG. 12 is a side view of the ladder of FIG. 4 folded in a storage position.

In an alternative embodiment, shown in FIG. 14, channels 1410 are formed in the sides of steps 1400. A cording 1412 wrapped with heavy nylon 1414 is inserted into channels 1410. The nylon 1414 is affixed by stitches 1416 onto the inside of the flexible body portion to support the steps on the flexible body portion 22. Channels 1410 may also be formed in a lower angled edge of the sides or on the bottom surface of the steps. The cording 1412 is inserted into the channels from the ends of the channels or held in place by a separate member secured onto the step.

This ladder, although described for use on a roof-top carrier, may also be used on other vehicles. For instance, this ladder is particularly useful on large equipment. Normally such equipment uses a fixed ladder in order for the operator to reach the operating position. However, the use of the present invention eliminates the need for a fixed ladder which can create an obstruction.

The present invention may also have use with commercial or utility trucks. These trucks often have items stored in upper portions of the vehicles which are difficult to access.

This invention can also be used with structures where a fixed ladder is not desired. The ladder of the present invention can be quickly and easily installed whenever such a need arises.

An additional embodiment of the present invention is usable on boats and other marine vehicles. The upper hook members are adapted to be secured over the edge of the boat whenever the boat is boarded. This is particularly useful when the individual is boarding from the water, such as a water-skier or scuba diver. The lower step segment is not buoyant so that it sinks beneath the water line in small boats. Additional weight may be added to the lower step segment to sink the lower step segment beneath the water line. This allows the individual to more easily step into the ladder. If necessary, additional steps can be included as well as the design of the upper hook members to engage the edge of the boat.

These and other features are provided by the present invention. It is to be expressly understood that the present invention is not limited to these descriptive embodiments and uses.

We claim:

1. A collapsible ladder for attachment to a vehicle, said ladder comprising:

a flexible body portion for compact folding for storage;

at least one outwardly-extending step;

means for affixing said at least one step to said flexible body portion; and means affixed to said flexible body portion for removably engaging a vehicle or structure on a vehicle;

means for maintaining said collapsible ladder securely on the vehicle as said at least one step has weight applied thereon; said means for maintaining includes a lower strap assembly affixed to a lower portion of said collapsible ladder; and a lower engaging hook affixed to said lower strap assembly for engaging a lower portion of the vehicle; said lower strap assembly includes an elastic member for maintaining said lower engaging hook put against the lower portion on a vehicle while the weight on said at least one step changes.

2. The collapsible ladder of claim I wherein said flexible body portion includes:

a high-strength flexible fabric.

3. The collapsible ladder of claim 1 wherein said collapsible ladder further comprises:

means for maintaining said collapsible ladder securely on the vehicle as said at least one step has weight applied thereon.

4. The collapsible ladder of claim 3 wherein said means for maintaining said collapsible ladder securely on the vehicle includes:

a lower strap assembly affixed to a lower portion of said collapsible ladder; and a lower engaging hook affixed to said lower strap assembly for engaging a lower portion of the vehicle.

5. The collapsible ladder of claim 4 wherein said lower strap assembly includes:

means for adjusting the length of said lower strap assembly.

6. The collapsible ladder of claim 1 wherein said removable engaging means include:

an upper strap assembly affixed to an upper portion of said flexible body portion; and an engaging member affixed on said upper strap assembly for engaging the vehicle or structure on the vehicle.

7. The collapsible ladder of claim I wherein said removable engaging means includes:

a first strap affixed to one side of a portion of said flexible body portion;

a first engaging hook member affixed onto said first strap for engaging the vehicle or structure on the vehicle;

a second strap affixed to a second side of said upper portion of said flexible body portion; and a second engaging hook member affixed onto said second strap for engaging the vehicle or structure on the vehicle.

8. The collapsible ladder of claim 7 wherein said first strap includes means for adjusting the effective length of said first strap; and said second strap includes means for adjusting the effective length of said second strap.

9. The collapsible ladder of claim 1 wherein said at least one step includes:

a substantially flat planar surface; and downwardly-extending side and rear surfaces.

10. The collapsible ladder of claim 1 wherein said collapsible ladder further comprises:

protective means affixed on the outer surface of said flexible body portion to minimize damage to a vehicle on which said collapsible ladder is attached.

11. A collapsible ladder for attachment to a vehicle, said ladder comprising:

a flexible body portion for compact folding for storage;

at least one outwardly-extending step having downwardly-extending side and rear surfaces;

pockets affixed to said flexible portion for receiving said downwardly-extending side and rear surfaces; and means affixed to said flexible body portion for removably engaging a vehicle or structure on a vehicle.

12. The collapsible ladder of claim 11 wherein said pockets further include:

means in said pockets for engaging slots formed in said downwardly-extending side surfaces.

13. A collapsible ladder for attachment to a vehicle, said ladder comprising:

a flexible body portion for compact folding for storage;

at least one outwardly-extending step;

channels formed in the sides of said at least one step;

cording means inserted into each of said channels; and means affixing said cording means to said flexible body portion; and means affixed to said flexible body portion for removably engaging a vehicle or structure on a vehicle.

14. A collapsible ladder for attachment to a vehicle, said collapsible ladder comprises:

a flexible body portion;

at least one step having a substantially flat planar portion;

means for affixing said at least one step to said flexible body portion;

an upper strap assembly secured to an upper portion of said flexible body portion;

an upper engaging member affixed on said upper strap assembly for engaging a vehicle or structure on a vehicle;

a lower strap assembly affixed to a lower portion of said flexible body portion; and a lower engaging member affixed on said lower strap assembly for engaging a lower portion of the vehicle to hold the collapsible ladder steady when in use.

15. The collapsible ladder of claim 14 wherein said upper strap assembly includes:

a cam-lock buckle for adjusting the effective length of said upper strap assembly.

16. The collapsible ladder of claim 14 wherein said upper strap assembly includes:

a swivel assembly to allow said upper engaging member to pivot relative to said flexible body portion.

17. The collapsible ladder of claim 14 wherein said lower strap assembly includes:

a cam-lock buckle for adjusting the effective length of said lower strap assembly.

18. The collapsible ladder of claim 14 wherein said at least one step includes:

downwardly-extending side and rear surfaces.

19. The collapsible ladder of claim 18 wherein said means for affixing said at least one step to said flexible body portion includes:

pockets affixed to said flexible portion for receiving said downwardly-extending side and rear surfaces of said at least one step.

20. The collapsible ladder of claim 14 wherein said at least one step includes:

a first step affixed to an upper portion of said flexible body portion; and a second step having a greater cross-sectional area than said first step affixed to a lower portion of said flexible body portion.

21. A method for mounting a collapsible ladder on a vehicle, said collapsible ladder having a flexible body portion and at least one step, said flexible body portion having two upwardly-extending adjustable length straps and a pivotally mounted hook on each strap and a downwardly-extending adjustable length strap with a hook mounted on the downwardly-extending adjustable strap, said method comprising the steps of:

(a) unfolding said collapsible ladder;

securing each of said hooks on said upwardly-extending straps on a vehicle or on structure attached to a vehicle;

(c) adjusting the length of said upwardly-extending straps so said at least one step is at an appropriate height;

(d) securing said hook on said downwardly-extending downwardly-extending strap to secure said collapsible ladder securely on the vehicle.

22. The method of claim 21 wherein said method further comprises the steps of:

releasing the pressure on said downwardly-extending strap;

removing said hook on said downwardly-extending strap from the lower edge of the vehicle;

removing the hooks on said upwardly-extending straps from the upper portion of the vehicle; and folding said collapsible ladder for compact storage.

* * * * *